United States Patent [19]

Gunneman

[11] Patent Number: 4,476,903

[45] Date of Patent: Oct. 16, 1984

[54] SHUTTLELESS WEAVING MACHINE

[75] Inventor: Paul Gunneman, Mierlo, Netherlands

[73] Assignee: Ruti-te Strake B.V., Deurne, Netherlands

[21] Appl. No.: 339,087

[22] Filed: Jan. 13, 1982

[30] Foreign Application Priority Data

Jan. 13, 1981 [CH] Switzerland ..... 196/81

[51] Int. Cl.[3] ..... D03D 47/34

[52] U.S. Cl. ..... 139/435; 139/450

[58] Field of Search ..... 139/429, 435, 443, 450; 226/97

[56] References Cited

U.S. PATENT DOCUMENTS

| | | | |
|---|---|---|---|
| 3,394,740 | 7/1968 | White | 139/435 |
| 3,675,687 | 6/1972 | Vermeulen et al. | 139/435 |
| 4,190,089 | 2/1980 | Cyvas | 139/452 |

FOREIGN PATENT DOCUMENTS

| | | | |
|---|---|---|---|
| 58074 | 9/1967 | Fed. Rep. of Germany . | |
| 1550547 | 8/1979 | United Kingdom | 139/435 |

*Primary Examiner*—Henry Jaudon

*Attorney, Agent, or Firm*—Burns, Doane, Swecker & Mathis

[57] ABSTRACT

In a shuttleless weaving machine with a nozzle for inserting the weft thread. The nozzle is furnished with a mixing tube, and the machine has a weft thread guide channel and a reed carried by a batten, for beating-up a weft thread. A thread clamp or holder is disposed in the mixing tube of the nozzle. This thread clamp or holder clamps the weft thread ahead of the point where the weft thread is cut. Thus, the weft thread is prevented from springing back into the nozzle. Accordingly, damage to the weft thread due to such springing-back is prevented, the weft thread is protected and conserved, the fabric quality is improved, and the area of applicability of jet weaving machines is broadened. In addition it is ensured that the leading end of the weft thread is blown into the weft thread guide channel in a position which is as close as possible to the desired position with respect to the guide channel transverse to the insertion direction.

8 Claims, 4 Drawing Figures

SHUTTLELESS WEAVING MACHINE

BACKGROUND AND SUMMARY OF THE PRESENT INVENTION

This invention relates to shuttleless weaving machines of a type having a nozzle for inserting a weft thread from a stationary yarn supply, a weft thread guide channel, a reed carried by a batten for beating-up the inserted weft thread, and a weft thread clamp or holder disposed between the yarn supply and the reed.

For a long time it was common practice with jet weaving machines of this type to mount the thread clamp or holder on the machine frame. However, after completion of the insertion of the weft and the closing of the thread clamp or holder, the reed is moved up to the fell of the cloth along with the inserted weft thread. This will cause an increase in the distance between the stationary thread clamp or holder and the crossing point between the weft thread and the edge of the warp thread array next to the thread clamp or holder. Therefore, when the thread clamp or holder is mounted in this manner the weft thread will be pulled back a certain distance from the shed during the beat-up and will be subjected to increased tension. This tension may lead to excessive stretching of the weft thread, particularly in the region between the thread holder and the neighboring end of the shed, and an excessively stretched weft thread tends to snap back when it is cut. This frequently leads to weft defects.

Attempts have been made to prevent the excessive stretching and the snapping-back of the weft thread by mounting the thread clamp or holder on the batten ahead of the thread entry opening. Although very good results have been attained through such positioning of the thread clamp or holder nonetheless with certain threads, particularly those with low twist and smooth surfaces, damage can occur in the region of the forward end of the weft thread, leading to weft defects. It has been assumed that these weft defects have their origins in the interaction between the fluid expelled by the nozzle and the weft thread, in the acceleration phase at the beginning of the insertion of the weft, and attempts have been made to improve the situation by modifying the nozzle. However, these attempts have not led to completely satisfactory results.

It is an object of the invention to prevent the referred-to damage of the weft thread. In doing this, the invention proceeds from the novel concept that even when the thread holder is mounted on the batten ahead of the nozzle the weft thread will still invariably be placed under tension to the extent that after it is cut it will snap back into the nozzle, whereby it is subject to damage, which damage may be so extensive that knots are formed in the weft thread.

In a non-previously-published prior patent application (European Pat. App. No. 80 10 3639.3) it was proposed to solve this problem by mounting the thread holder between the nozzle and the reed. With this positioning of the thread holder the weft thread is prevented from snapping back into the nozzle, thus avoiding all irregularities caused by such snapping back. This leads not only to improved protection and conservation of the weft thread and better fabric quality but also to an extension of the area of application of jet weaving machines which has not been regarded as possible heretofore, since under the proposed solution even slightly twisted and smooth yarn may be used for the weft thread.

The underlying object of the present invention is to refine this general arrangement in such a way that the leading end of the weft thread is expelled from the nozzle into the weft thread guide channel at a position which is as close as possible to the desired position with respect to the cross section of said guide channel transverse to the insertion direction.

This object is achieved according to the invention by disposing the thread clamp or holder in the nozzle itself.

In a preferred embodiment of the shuttleless weaving machine, in which the nozzle is furnished with a mixing tube on the side where the weft thread exits, the thread holder is disposed in that mixing tube.

As a result of the inventive disposition of the thread clamp or holder inside the nozzle or mixing tube, the nozzle and mixing tube may be positioned very close to the weft thread guide channel, whereby as a result of the short distance between the exit side of the mixing tube and the weft thread guide channel the probability that the weft thread will deviate transversely from its desired position with respect to the weft thread guide channel is greatly reduced. Furthermore, under this arrangement such deviations cannot be caused by a thread holder disposed between the mixing tube and the weft thread guide channel, because there is no thread holder disposed in this region.

BRIEF DESCRIPTION OF THE DRAWINGS

The invention will now be explained in more detail with reference to exemplary embodiments and the drawings. In the drawings.

DETAILED DESCRIPTION OF THE PREFERRED EMBODIMENTS

Figure 1:
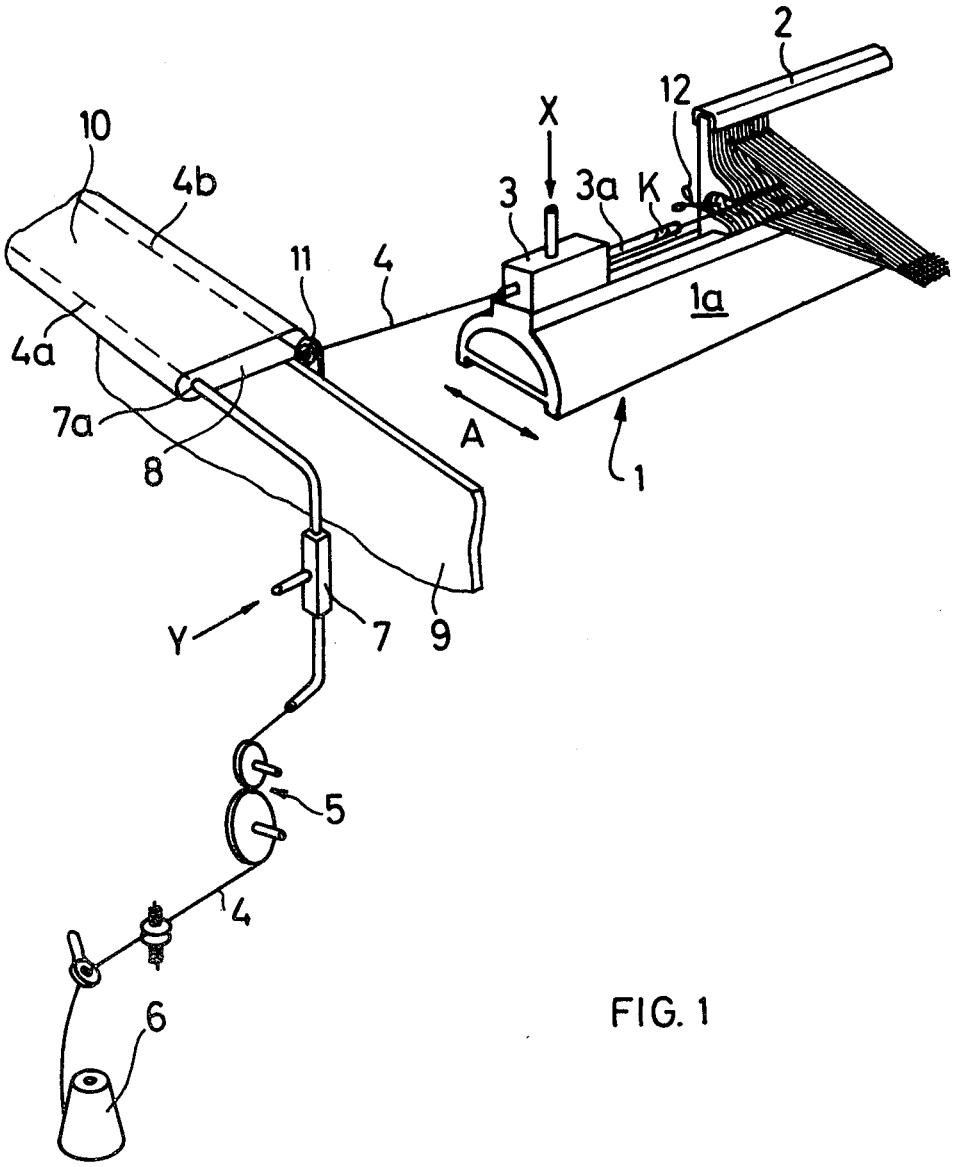
FIG. 1 is a schematic perspective view of the parts of an air jet weaving machine which need to be depicted for an understanding of the invention.

With reference to FIG. 1, a part 1 of the batten, which is movable in the direction of the double arrow A carries a beam 1*a* on which the reed dents forming the reed 2 are mounted. In known fashion, the reed dents bound a weft thread guide channel through which the weft thread 4 is inserted in the shed. Also mounted on the beam 1*a* is a nozzle 3 with a mixing tube 3*a* which is supplied with compressed air in the direction of arrow X and is mounted in alignment with the weft thread guide channel.

The weft thread 4 is drawn off in known fashion from a stationary yarn spool or supply 6 by constantly rotating wheels 5. The weft thread delivered by the wheels 5 is fed to a compressed air nozzle 7, the exit end 7*a* of which is directed at the opening 8 of an accumulator device 10 which is attached to the weaving machine frame 9 and which has a flat shape. This accumulator device 10 is of a type which is itself known. The end thereof which is not shown in the Figure may be connected to a vacuum source. The thread in the accumulator device 10 forms a loop with an entry arm 4*a* and an exit arm 4*b*. The accumulator device 10 is continuously fed weft thread by the compressed air nozzle 7 in the direction of the entry arm 4*a*, and a certain length of thread is withdrawn intermittently by nozzle 3 from the exit arm 4*b*, namely on the occasion of each thread insertion, in an amount which depends on the length of thread which has been accumulated. This withdrawn length is inserted in the shed. The withdrawn thread is fed through a stationary guide eye 11, onward to the nozzle 3.

A cutting device 12, shown schematically, is provided between the thread exit end of the mixing tube 3*a* of the nozzle 3 and the thread entry end of the weft thread guide channel, which channel is formed by the reed dents.

A thread holder K is mounted in the mixing tube 3*a*, namely in the region upstream of the weft thread exit end of the mixing tube and substantially adjacent the exit end of the mixing tube. This holder has the function of holding the weft thread 4 fast for a time, following the completion of each weft thread insertion and prior to the cutting of the inserted weft thread by the cutting device 12. The holder then releases the thread at the beginning of the insertion of the next weft thread.

Figure 2:
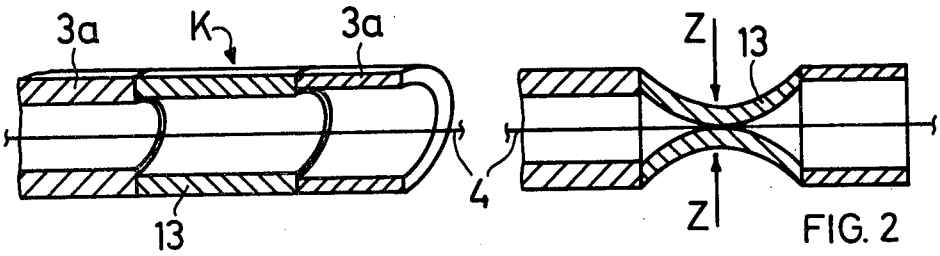
FIGS. 2 to 4 are each longitudinal cross sectional views through the mixing tube of the nozzle of the air jet weaving machine of FIG. 1, each Figure showing a different exemplary embodiment of a thread clamp or holder according to the invention.
Figure 3:
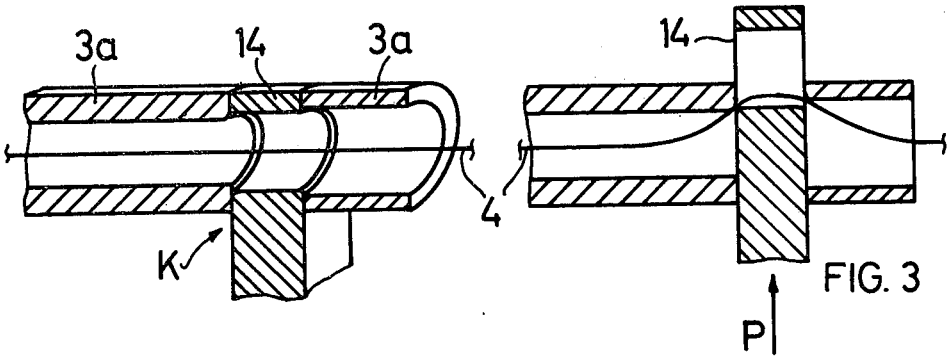
Figure 4:
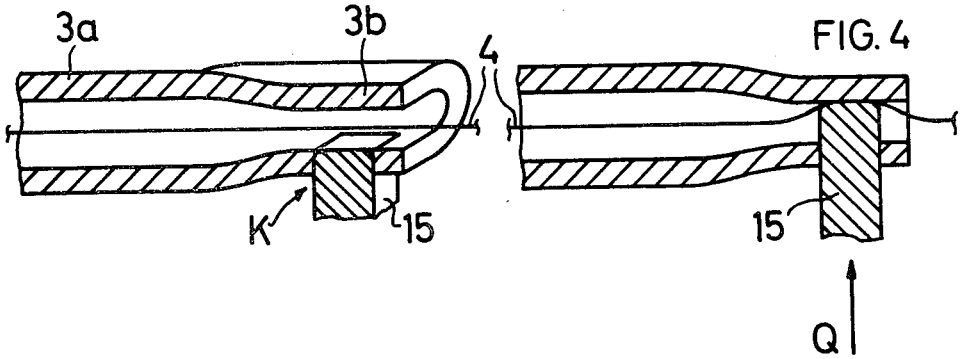

On the left side of each of FIGS. 2 to 4, the thread holder is shown in its inactive state, and on the right side it is shown in its active state.

The invention is not limited to the configuration shown. For example, it might be advantageous to position the thread holder K in the mixing tube 3*a* in a weaving machine in which the nozzle 3 is not mounted on the batten but is attached to the machine frame. Further, a second thread holder may be employed ahead of the nozzle 3, in addition to the thread holder K in the mixing tube 3*a*. This second thread holder may be mounted either on batten 1 (as described in Brit. Pat. No. 1,550,547) or on the machine frame.

In the first exemplary embodiment of FIG. 2, the thread holder K is in the form of an elastic intermediate piece 13 inserted in the mixing tube 3*a*, which intermediate piece may comprise, for example, a metal-reinforced hose. The intermediate piece 13 is associated with two diametrically opposite reciprocable elements, symbolized by the arrows Z, which are moved toward each other to produce the clamping action of the thread holder. In order to prevent the free end of mixing tube 3*a* which adjoins intermediate piece 13 on the weft insertion side (the right side, in the Figure) from oscillating uncontrollably when the thread holder is operated, this mixing tube end section can be held against beam 1*a* (FIG. 1), or the intermediate piece 13 can be in two sections, so that the neighboring parts of mixing tube 3*a* which adjoin the intermediate piece 13 on the left and right (FIG. 2) can be connected via two intermediate ripples (e.g., a bellows-type connection). These connecting ripples will then separate the two parts of the intermediate piece 13 from each other.

In order to ensure that the flow in mixing tube 3*a* is not affected by the intermediate piece 13, the interior diameter of intermediate piece 13 is greater than the interior diameter of the part of the mixing tube 3*a* which is upstream of it in the weft insertion direction, and, further, the interior diameter of the part of mixing tube 3*a* which is downstream of intermediate piece 13 in the weft insertion direction is greater than that of the intermediate piece 13.

The thread holder K of FIG. 3 is in the form of a reciprocable element 14 provided with a bore hole which has a diameter which is greater than the interior diameter of the part of mixing tube 3*a* lying upstream of it in the weft insertion direction, and less than the interior diameter of the part of mixing tube 3*a* lying downstream of it in the weft insertion direction.

In the inactive position of thread holder K, the center line of the bore hole of reciprocable element 14 is aligned with the center line of the mixing tube 3*a*. For operating thread holder K, the reciprocable element 14 is moved upward in the direction of arrow P to the extent that the lower edge of the bore hole of reciprocable element 14 is moved approximately to the level of the corresponding upper edge of the bore hole of the part of mixing tube 3*a* which lies upstream of the reciprocable element 14 in the weft insertion direction. The bore hole of the mixing tube 3*a* and that of reciprocable element 14 are both rounded in shape in the region of the edges.

In the further embodiment of FIG. 4, the mixing tube 3*a* has a part 3*b* in the region of the tube which is downstream in the weft insertion direction, the cross section of which section 3*b* is not circular but is flattened, i.e., bounded by two parallel planes and two semicircular surfaces joining said parallel planes. The thread holder K is in the form of a bar 15 which may be moved in a reciprocating motion perpendicular to the planes in the direction of arrow Q; and one of the surfaces one of the planes (the upper surface, in FIG. 4) forms a matching stop surface for the bar 15, and thus forms a part of the thread holder K—namely, the fixed part of a clamp arrangement.

The principles, preferred embodiments and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by other without departing from the spirit of the present invention. Accordingly, it is expressly intended that all such variations and changes which fall within the spirit and scope of the present invention as defined in the claims be embraced thereby.

I claim:

1. A shuttleless weaving machine, comprising a nozzle for inserting a weft thread from a stationary yarn supply, said nozzle provided with a mixing tube mounted in alignment with a guide channel for the weft thread, said machine further comprising a reed carried by a batten for beating-up the inserted weft thread, and a thread holder disposed between the yarn supply and the reed, the thread holder being disposed directly within the mixing tube wherein the thread holder is an elastic intermediate piece installed in the mixing tube, said intermediate piece being associated with two oppositely positioned reciprocable elements which are adapted to be moved with each other in a head-on fashion.

2. Shuttleless weaving machine according to claim 1, wherein the elastic intermediate piece comprises a metal-reinforced hose or tubing section.

3. A shuttleless weaving machine, comprising a nozzle for inserting a weft thread from a stationary yarn supply, said nozzle provided with a mixing tube mounted in alignment with a guide channel for the weft thread, said machine further comprising a reed carried by a batten for beating-up the inserted weft thread, and a thread holder disposed between a yarn supply and a reed, the thread holder being disposed directly within the mixing tube, wherein the mixing tube has a flattened configuration in a portion which contains the thread holder, said flattened configuration including two parallel bounding plane surfaces in its cross-section, the thread holder being a bar which is movable in a reciprocating motion perpendicularly to said plane surfaces, one of said plane surfaces forming a matching stop surface for said bar.

4. Shuttleless weaving machine according to claim 1 or 3, wherein the thread holder is disposed in the region of the weft thread exit end of the mixing tube.

5. Shuttleless weaving machine according to claim 1 or 3, wherein the thread holder is disposed at a distance upstream from the weft thread exit end of the mixing tube.

6. A shuttleless weaving machine, comprising a nozzle for inserting a weft thread from a stationary yarn supply, said nozzle provided with a mixing tube mounted in alignment with a guide channel for the weft thread, said machine further comprising a reed carried by a batten for beating-up the inserted weft thread, and a thread holder disposed between the yarn supply and the reed, the thread holder being disposed directly within the mixing tube and substantially adjacent an exit end of the mixing tube, wherein the thread holder is a reciprocable element having a bore hole, a center line of the bore hole being aligned with the center line of the mixing tube when said holder is in an inactive state, and said reciprocable element being movable transversely to the mixing tube for holding the weft thread fixed.

7. Shuttleless weaving machine according to claim 1 or 6, wherein an interior diameter of the thread holder is greater than an interior diameter of the part of mixing tube which lies upstream of the thread holder in the weft insertion direction, and is smaller than an interior diameter of the part of mixing tube which lies downstream of the thread holder in the weft insertion direction.

8. Shuttleless weaving machine according to claim 1 or 6 or 3, wherein the nozzle, the mixing tube and the thread holder are all mounted on the batten and oscillate with the batten and the reed during weaving operations.

* * * * *

UNITED STATES PATENT AND TRADEMARK OFFICE

CERTIFICATE OF CORRECTION

PATENT NO. : 4,476,903

DATED : October 16, 1984

INVENTOR(S) : Paul Gunneman

It is certified that error appears in the above-identified patent and that said Letters Patent is hereby corrected as shown below:

IN THE ABSTRACT:

In the next to the last line, after "respect to", please insert --the cross-section of--.

Signed and Sealed this

*Eleventh* Day of *June 1985*

[SEAL]

*Attest:*

DONALD J. QUIGG

*Attesting Officer*

*Acting Commissioner of Patents and Trademarks*